US006040511A

United States Patent [19]

Hall

[11] Patent Number: 6,040,511

[45] Date of Patent: Mar. 21, 2000

[54] METHOD OF OPTIMIZING A GUITAR TREMOLO

[76] Inventor: Brian W. Hall, 52 Ann's La., Hampton, N.H. 03842

[21] Appl. No.: 09/228,912

[22] Filed: Jan. 11, 1999

[51] Int. Cl.[7] ..... G10D 3/00

[52] U.S. Cl. ..... 84/313

[58] Field of Search ..... 84/313

[56] References Cited

U.S. PATENT DOCUMENTS

| | | | |
|---|---|---|---|
| 4,171,661 | 10/1979 | Rose | 84/313 |
| 4,724,737 | 2/1988 | Fender | 84/313 |
| 4,882,967 | 11/1989 | Rose | 84/313 |
| 4,939,971 | 7/1990 | Satoh | 84/313 |
| 4,967,631 | 11/1990 | Rose | 84/313 |
| 5,373,769 | 12/1994 | Sherman | 84/313 |
| 5,413,019 | 5/1995 | Blanda, Jr. | 84/298 |
| 5,551,329 | 9/1996 | Iovare | 84/313 |
| 5,747,713 | 5/1998 | Clement | 84/313 |

*Primary Examiner*—Robert E. Nappi
*Assistant Examiner*—Shih-yung Hsieh
*Attorney, Agent, or Firm*—Bourque & Associates, P.A.

[57] ABSTRACT

A method of tuning a spring-loaded tremolo device, which substantially balances the stresses applied to a guitar system at rest and, which substantially balances the stresses applied to the guitar system when the tremolo device is operated is disclosed. The method begins by asymmetrically loading the tremolo device in a manner that counteracts the differing tensions applied to the guitar by the different guitar strings and, in part, the offset position of the tremolo control arm on the tremolo device's bridge plate. Then, the guitar is tuned to pitch by adjusting the guitar string tension by adjusting both the string tension tuners, which are typically provided on the headstock at the remote end of the guitar's neck, and the tension on the tremolo springs.

8 Claims, 5 Drawing Sheets

METHOD OF OPTIMIZING A GUITAR TREMOLO

BACKGROUND

In 1954, Leo Fender developed a tremolo device to be included on the new Fender® Stratocaster® guitar. Leo Fender's tremolo device was the subject matter of U.S. Pat. No. 2,741,146, which is incorporated herein by reference. The purpose of a tremolo system is to provide a system that allows the guitar string tension, which provides the desired pitch of each string, to be altered. The result is that the pitch of the guitar strings may be varied, to either a lower pitch (flat) or a higher pitch (sharp). The lower and higher pitch variations are provided by, respectively loosening and tightening the guitar string tension.

In simplified terms, the Fender Stratocaster tremolo system includes a movable bridge, which rocks on a fulcrum to reduce and increase string tension. The bridge is biased in a normal position by a series of springs, which counteract the forces applied by string tension. A first end of each spring is attached to the bridge while the opposite end of each spring is rigidly attached to the guitar body.

The simplicity of the Stratocaster-type spring-loaded tremolo system has resulted in the widespread copying of the system for use in countless numbers of copies of the Fender Stratocaster, which are manufactured and sold each year. In fact, the Fender Stratocaster is the single most copied guitar sold around the world. Additionally, the basic design of the Fender Stratocaster-type tremolo system has been applied to countless other electric guitars manufactured and sold by a vast number of guitar manufacturers.

However, even though the Fender Stratocaster and similar guitars that incorporate the Fender Stratocaster-type tremolo system design are in widespread production and use throughout the world, the Stratocaster-type tremolo device incorporates a fundamental design flaw, which results in the inability for guitars using this type of tremolo system to remain in tune if the tremolo system is utilized by the guitarist.

The basic problem is one of geometry and symmetry. First, as shown in FIGS. 1–4, the Fender Stratocaster-type tremolo device incorporates a tremolo control arm, which is offset with respect to the bridge plate as a whole. Additionally, and perhaps even more significantly, since guitar strings are tuned to pitch by applying different tensions to the different strings, the stresses placed upon the guitar system by the string tension is uneven. For example, the low E-sting, which is under less tension when compared to the remaining guitar strings, applies far less stress to the guitar than, for example, the high E-string, which is under relatively greater tension. This results in an imbalance in the stresses that are placed on the guitar in general and on the guitar's neck, in particular.

The combination of uneven stresses applied to the guitar neck under normal string tension and the effect of the offset tremolo bar results in a great deal of imbalance in the instrument, which causes repeated twisting and untwisting of the guitar's neck and headstock when the tremolo system is utilized. This repeated twisting and untwisting, even over a short period of time, results in the guitar deviating from the proper pitch generated by the vibration of its strings since it is virtually impossible for the guitar neck, strings and bridge to return to precisely the same at rest position.

Over the years, many attempts have been made to design tremolo systems that overcome the Stratocaster-type tremolo deficiencies. However, all such tremolo systems, to a certain degree, exhibit the same failure to return to the neutral position. Accordingly, what is needed is a method of tuning a Stratocaster-type tremolo system to ensure that, upon repeated operation of the tremolo systems, the neck, string and bridge components all return to substantially the same position and alignment so that the guitar remains in tune.

SUMMARY OF THE INVENTION

The disclosed invention overcomes these and other limitations by providing a method of tuning a spring-loaded tremolo device, which substantially balances the stresses applied to a guitar system at rest and, which substantially maintains the balance when the tremolo device is operated. The method begins by asymmetrically loading the tremolo device in a manner that counteracts the differing stresses applied to the guitar by the differing string gauges and string tensions and, in part, the offset position of the tremolo control arm on the tremolo device's bridge plate. In one preferred embodiment, the asymmetrical loading is accomplished by applying asymmetrical tremolo spring tension to the tremolo device.

Then, the guitar is tuned to pitch by adjusting the guitar string tension by adjusting both the guitar string tuners, which are typically provided on the headstock at the remote end of the guitar's neck, and the tension on the tremolo springs.

DESCRIPTION OF THE DRAWINGS

These and other features of the present invention will be more fully understood by reading the following detailed description, taken together with the drawings, wherein.

DESCRIPTION OF THE INVENTION

Figure 1:
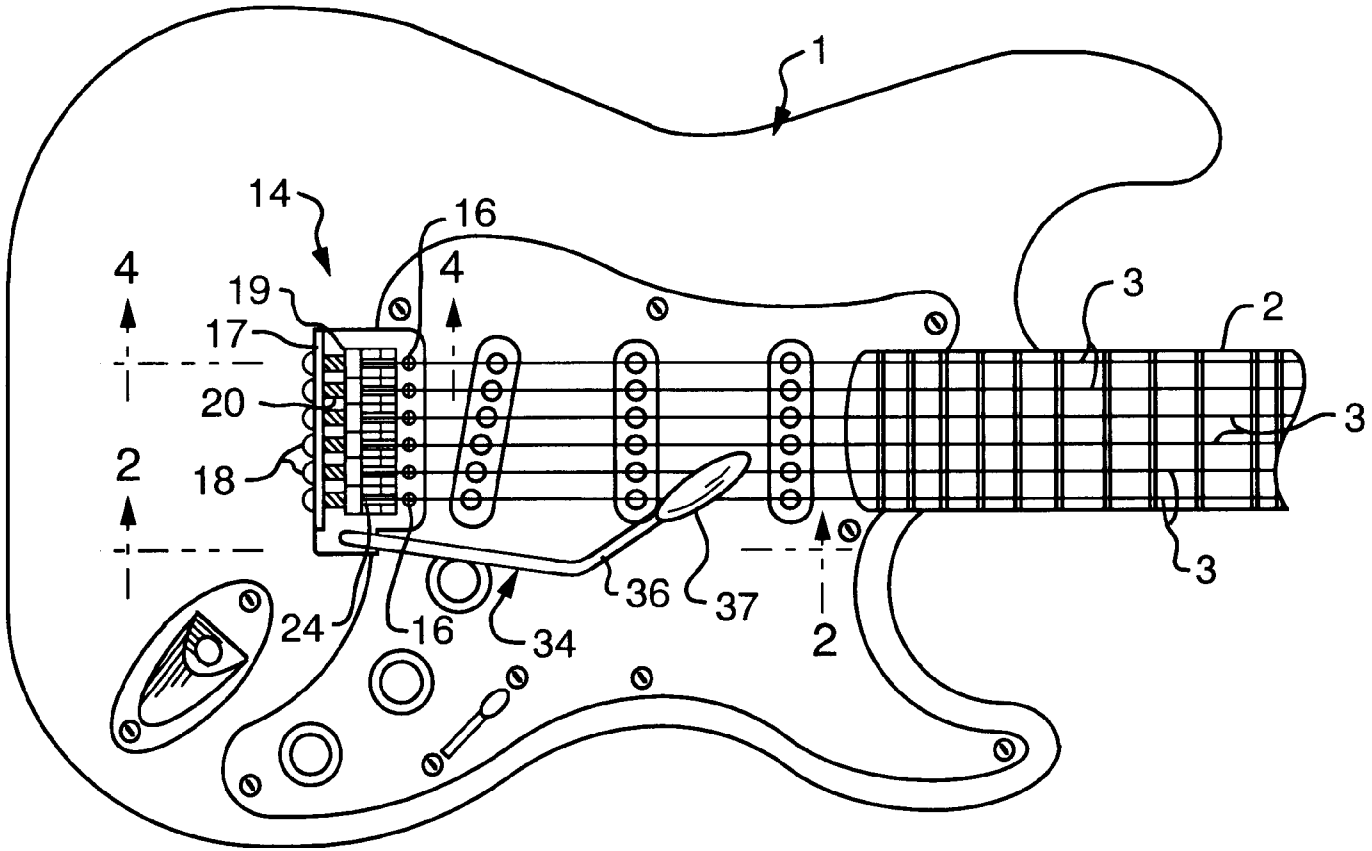
FIG. 1 (PRIOR ART)
FIG. 1 is a top view of a prior art Stratocaster-type guitar, which includes a prior art Stratocaster-type, spring-loaded tremolo device, according to the teaching of U.S. Pat. No. 2,741,146.
Figure 4:
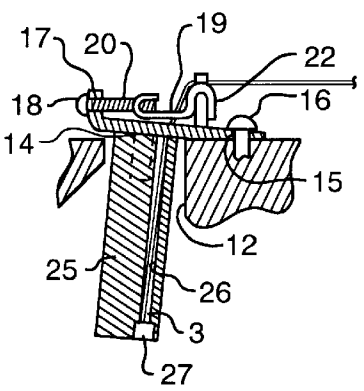
FIG. 4 (PRIOR ART)
FIG. 4 is a sectional side view of the prior art tremolo device of FIG. 1.
Figure 3:
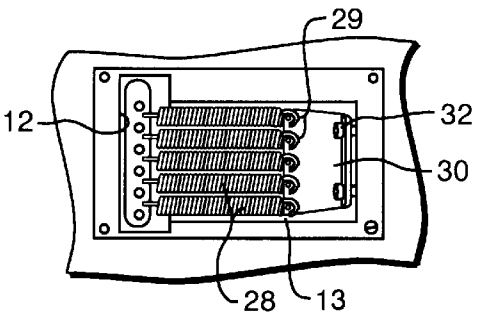
FIG. 3 (PRIOR ART)
FIG. 3 is a bottom view of the prior art tremolo device of FIG. 1.
Figure 2:
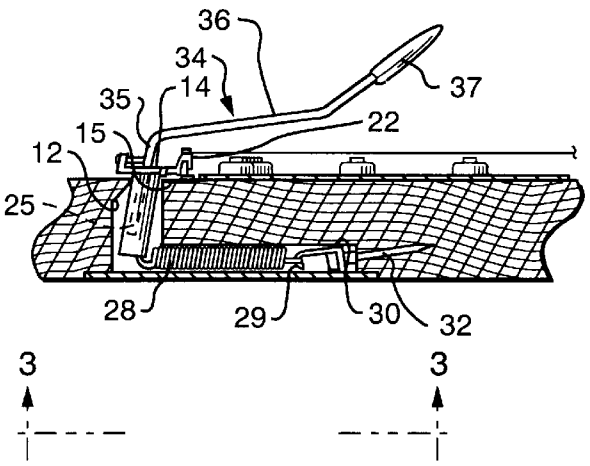
FIG. 2 (PRIOR ART)
FIG. 2 is a sectional side view of the prior art tremolo device of FIG. 1.

The basic, Stratocaster-type, spring-loaded tremolo device according to the teachings of U.S. Pat. No. 2,741,146 is shown in FIGS. 1–4. Although the Stratocaster-type tremolo device has evolved slightly over the years, the basic principles of its construction and operation have remained substantially since its invention in 1954 until the present. The guitar includes a body 1, from which extends a neck 2 terminating in a headstock, not shown. The headstock includes a plurality of guitar string tuning machines, not shown, which are used to adjust the tension on the guitar strings to provide desired string pitch. Strings extend from a bridge, which will be more fully described below, over the body and neck. Formed in the body 1 is a transverse slot 12, which communicates at the under side of the body with a recess 13 directed toward the neck 2. Mounted on the body 1 adjacent the slot 12 is a base plate 14, one edge of which is beveled to form a fulcrum ridge 15. The beveled edge of the base plate 14 is secured to the body 1 by screws 16, which permit limited pivotal movement of the base plate about the fulcrum 15. The fulcrum is located forwardly of the slot 12, that is toward the neck 2.

The base plate 14 overlies and covers the slot 12 and is provided at its rear edge with an upturned flange 17. Tension screws 18, one for each string 3, extend forwardly through the flange 17 and are screw threaded into sectional bridge elements 19. Springs 20 are interposed between the bridge elements 19 and the flange 17.

Secured to the inner side of the base plate 14 is a bar 25 which extends into the slot 12. The bar is provided with a plurality of vertically extending bores 26, one for each string 3. Each string passes over a corresponding bridge element 19, through a slot 24 in each bridge element 19 and into the corresponding bore through a registering hole in the base plate 14. The extremity of each string is provided with an anchor element 27, which seats in an enlarged portion of a counterbore formed at the lower extremity of the corresponding bore 26.

Secured to the lower extremity of the bar 25 are a plurality of tension springs 28. These springs extend forwardly within the recess 13 and are relatively stiff. The forward extremities of the tension springs are retained by hooks 29 formed along a rear edge of a tension plate 30. The tension plate has a flange 31 at its forward edge, which receives screws 32 adapted to be driven into the body at the forward extremity of the recess 13.

One lateral edge of the base plate 14 and bar 25, preferably the edge which constitutes the lower side of the instrument when in the playing position, is extended and receives a control arm 34. The control arm includes a vertical portion 35, which journals in the bar 25 and a laterally directed portion 36 terminating in a handle 37. In the normal playing position, the handle 37 is disposed above and slightly below the strings 3 so as to be received in the palm of the guitarist's hand.

In operation, if the handle 37 is not engaged or is held against movement, the guitar is played in a conventional manner and no tremolo effect is observable. However, if the handle 37 is oscillated to and from the body 1 during vibration of any or all of the strings 3, a tremolo effect will be produced by each of the vibrating strings.

The bar 25 is relatively massive, preferably of solid material and the tension springs 28 are preferably quite stiff, so that unless the control arm 34 is manually oscillated there is no tendency for the bar 25 or springs 28 to vibrate when the strings are plucked. The mass of the bar 25 and stiffness of the springs 28 may, however, be maintained at a minimum because of the relatively close coupling of the bridge portions 22 and the fulcrum ridge 15.

According to the teachings of the present invention, a Stratocaster-type, spring-loaded tremolo device can be optimized by a tuning method, which results in the virtual elimination of unnecessary stresses upon the guitar system as a whole and which effectively balances the tension across the guitar strings such that manipulation of the tremolo control arm tensions and detensions the strings of the guitar evenly, thus maintaining the balance of the stresses applied to the guitar. The net result is that a guitar incorporating a Stratocaster-type, spring-loaded tremolo device that is tuned according to the following method will not exhibit any appreciable variations in its string tuning, even after repeated, severe manipulations of the tremolo device.

By way of example, the tuning method will be described as it is applied to the Fender Stratocaster-type tremolo device explained above. However, as will be appreciated by those skilled in the art, the method of the present invention is equally applicable to any tremolo device that utilizes spring tension to maintain the bridge position as it is pulled under the tension imparted upon it by the guitar strings.

Figure 5:
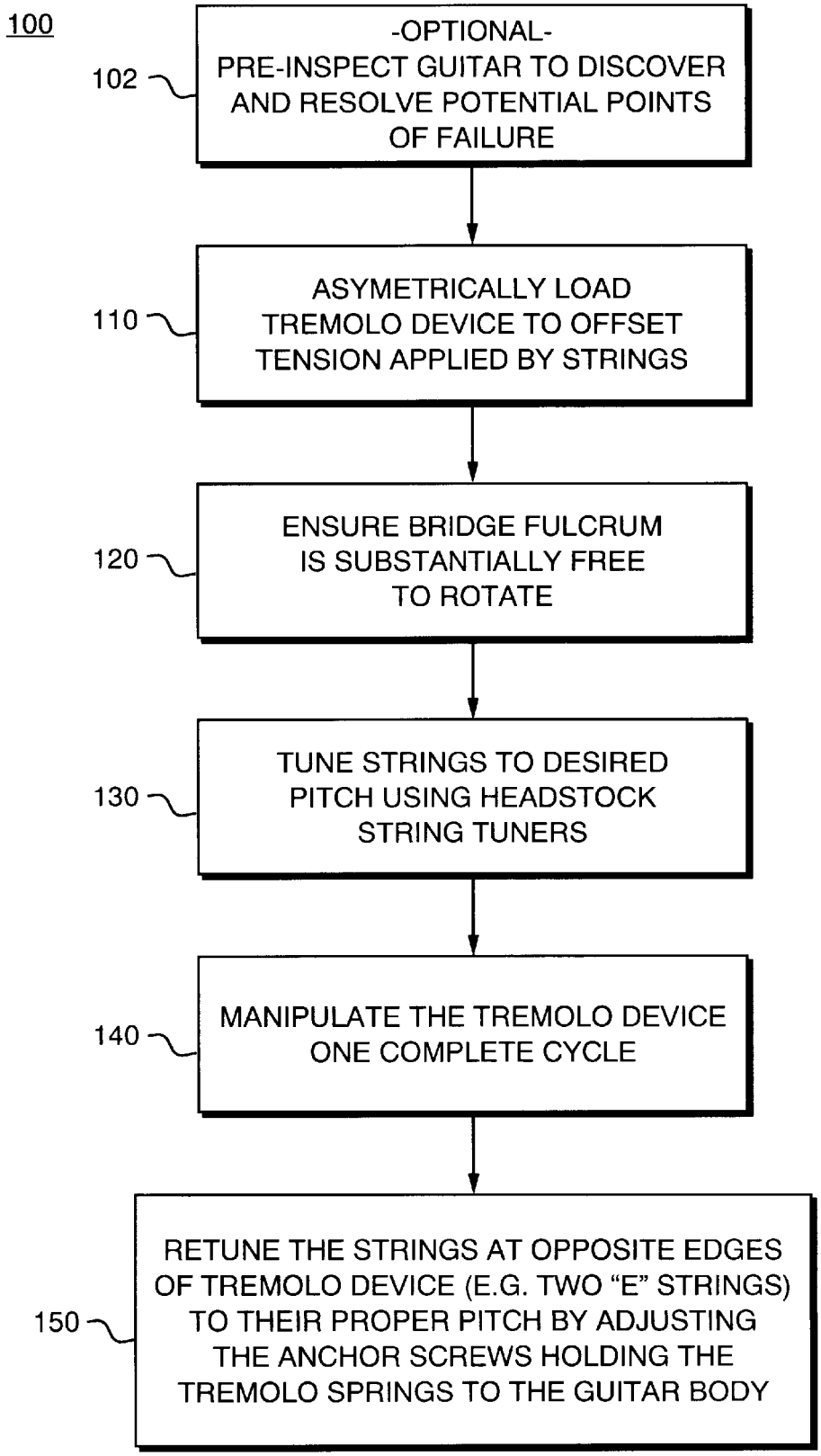
FIG. 5 is a flow chart, which provides the steps of tuning a spring-loaded tremolo device according to the teachings of the present invention.

Turning now to FIG. 5, a method 100 of optimizing a spring-loaded tremolo device by tuning the tremolo springs is disclosed. As an optional pre-requisite for performing the steps of the method 100, which would ensure optimum performance of a guitar including a tremolo device tuned according to the present method, the guitar may be pre-inspected, step 102.

The pre-inspection step should be tailored to discover and resolve any potential points of failure. Examples of points that should be inspected include, the tuners, the neck set, and any points where the guitar strings may get snagged, such as the nut, the bridge elements and the headstock string pull-downs. Additionally, the bridge base plate 14 (FIG. 1) should be closely inspected to ensure that it does not rub against the pickguard at any point throughout the complete travel range of the tremolo bridge. Any issues discovered during the inspection step should be resolved before continuing.

The next step of the tuning method is to effectively counteract or offset the uneven stresses applied to the guitar system under normal guitar string tension by asymmetrically loading the tremolo device, step 110. The normal, uneven stresses result from the tuning of guitar strings to differing pitches by applying differing tension to the strings. In essence, the asymmetrical loading of the tremolo device using the tremolo tension springs applies stresses upon the tremolo device, which substantially counteract the stresses applied by the guitar strings. This effectively balances the instrument and substantially eliminates the twisting and untwisting of the guitar neck and headstock in relation to the guitar body as the tremolo device is manipulated. In fact, a guitar optimized according to the teachings of the present invention is so "balanced" that it will exhibit minor variations in pitch as the guitar is rotated from a string-up orientation to a string-down orientation—i.e. the guitar is so balanced that its pitch is effected by gravity.

Figure 6:
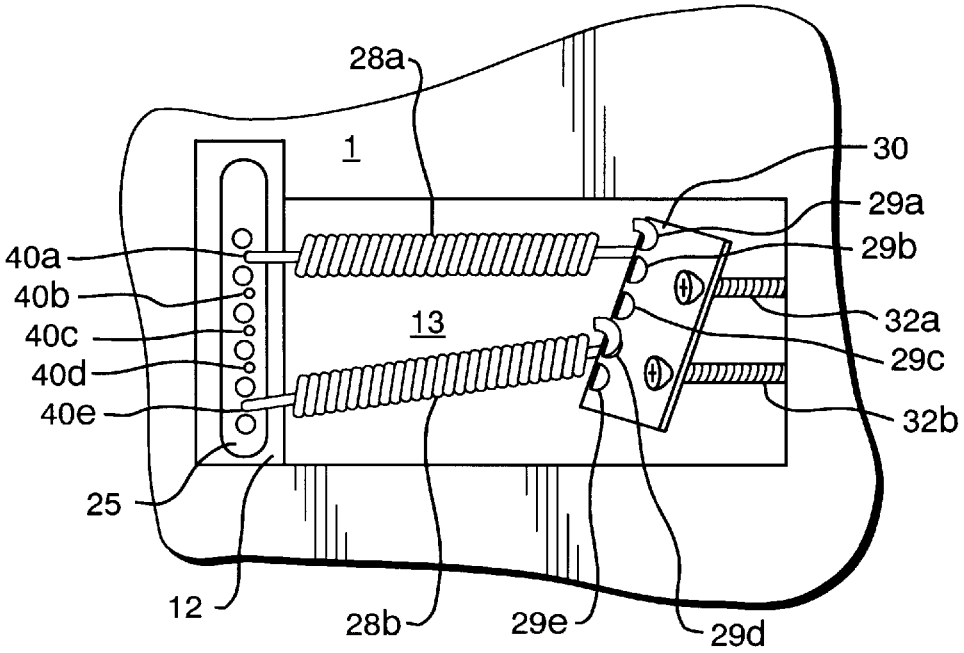
FIG. 6 is a back view of a guitar tremolo device showing one tremolo spring configuration, which balances the stresses applied to the guitar system, including its neck and tremolo device, by applying an asymmetrical tremolo spring configuration using standard tremolo springs, according to the teaching of the present invention.
Figure 7:
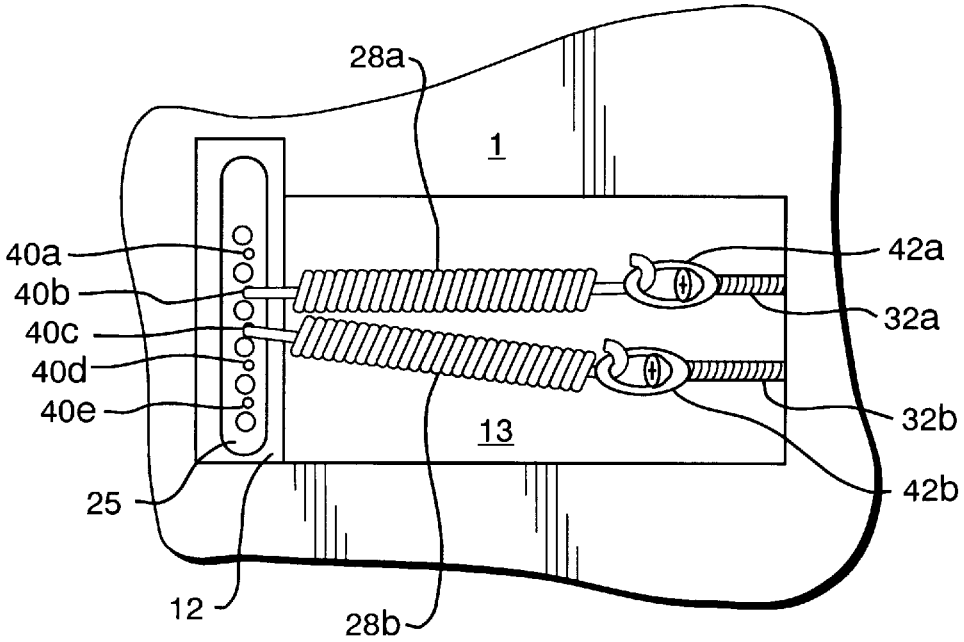
FIG. 7 is a back view of a guitar tremolo device showing a second asymmetrical tremolo spring configuration, which balances the stresses applied to the guitar system, according to another embodiment of the present invention.

FIGS. 6 and 7 show two alternative, asymmetrical tremolo spring arrangements, which utilize "stock", Stratocaster-type tremolo springs to impart asymmetrical tension upon the tremolo device. The bar 25 (FIG. 6) includes five spring holes 40, each configured to accept a first end of a tremolo tension spring 28. Likewise, the tension plate 30 includes five retaining hooks 29, each for holding a second end of the tremolo tension spring 28. Labeling each hole 40*a*–40*e* and each retaining hook 29*a*–29, as shown in FIG. 6, the asymmetrical spring configuration shown can be described as connecting a first tremolo spring 28*a* from hole 40*a* to hook 29*a* and a second tremolo spring 28*b* from hole 40*e* to hook 29*d*.

Other asymmetrical spring configuration are equally applicable and provide minor variations in the feel of the guitar. For example, a second asymmetrical configuration could be described as stretching a first tremolo spring 28*a* from hole 40*c* to hook 29*b* and a second tremolo spring 28*b* from hole 40*d* to hook 29*d*.

Spring arrangements, which utilize two tremolo tension springs, work especially well with light gauge strings, such as "9s", which range in thickness from 0.009 in. to 0.042 in. For heavier strings, such as "10s", which may range in thickness from 0.010 in. to 0.046 in or "11s", which range in thickness from 0.011 inches to 0.049 in or 0.050 in., additional springs or "heavier"springs may be utilized.

In any event, the above-identified asymmetrical spring configurations or other asymmetrical configurations provide the desired asymmetrical tremolo device loading when tremolo springs having substantially the same length and strength are utilized. Thus, the guitar system is effectively balanced, thereby offsetting the uneven tension applied to the guitar system by the different gauge guitar strings and, to some degree, the offset torque applied to the tremolo device when it is operated due to the offset nature of the tremolo control arm 34. Of course, the same effect can be accomplished by selecting different springs, having different strengths and characteristics, even using symmetrical spring configurations.

FIG. 7 shows another embodiment of an asymmetrical spring arrangement, wherein the tension plate 30 is replaced by a hook 42 on each of the two anchor screws 32, which would otherwise hold the tension plate 30 in position. In this embodiment, a first tremolo spring 28*a* is stretched between hole 40*b* and hook 42*a* and a second tremolo spring 28*b* is stretched between hole 40*c* and hook 42*b*.

The asymmetrical tremolo device loading can be further enhanced by adjusting the anchor screws so that they extend different amounts into recess 13. In the embodiment of FIG. 6, anchor screw 32*b* is threaded into the guitar body 1 so that its head extends substantially 1 inch into recess 13. Anchor screw 32*a* is screwed into the body 1 until the retention plate 30 just begins to move down the shaft of anchor screw 32*b*. At this point, the anchor screw 32*a* may be repositioned outward slightly to ensure that the retention plate 30 is seated on the head of both anchor screws 32.

Figure 8:
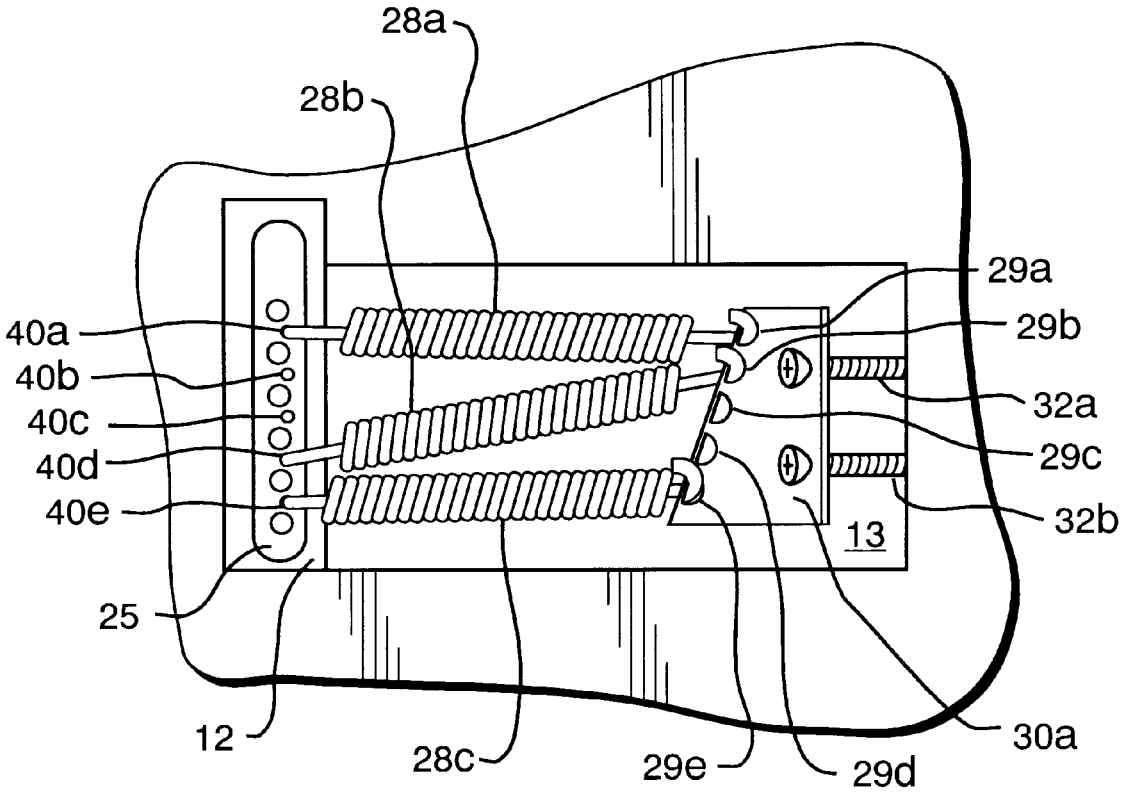
FIG. 8 is a back view of a guitar tremolo device showing an asymmetrical tremolo spring tension plate according to another embodiment of the present invention.

In the configuration of FIG. 7, anchor screw 32*b* is threaded into the guitar body 1 so that its head extends substantially 1 inch into recess 13. Anchor screw 32*a* is screwed into the body 1 until its head extends into recess 13 somewhat less than anchor screw 32*b*, and, in one prefered embodiment, substantially between 0.5 and 0.75. Of course, as indicated above, any tension plate orientation and spring configuration that counteracts the uneven stresses applied to the guitar system by the guitar strings may be utilized. As shown in FIG. 8, asymmetrical tension plate 30*a* is shown, which provides the same asymmetrical effect described above with respect to using a standard tension plate that is skewed within recess 13 by unequal adjustment of anchor screws 32*a* and 32*b*. FIG. 8 also shows a third tremolo tension spring 28*c*.

Returning to the method 100 of FIG. 5, once the tremolo device is asymmetrically loaded, the method continues by ensuring that the bridge fulcrum is substantially free to rotate, step 120. Bridge fulcrum free rotation may be enhanced by loosening the base plate hold-down screws 16 (FIG. 1) slightly. In one preferred embodiment, the two screw 16*a* and 16*e*, which are at the opposite edges of the base plate 14 are loosened substantially between one-half and three-quarters of a screw rotation. The remaining three screws, 16*b*, 16*c*, and 16*d* are loosened substantially between three-quarters and one complete rotation. Of course bridge plates utilizing different hold down configurations, such as the Fender American Standard Tremolo, may require different implementations of the same strategy—namely, freeing its fulcrum to allow for substantially unrestricted pivotal movement.

The tuning method continues by tuning the guitar strings 3, using the headstock tuners (not shown) to their desired pitch, step 130. For example, the asymmetrical tremolo device loading strategies described above are especially useful for a standard "EBGDAE" guitar tuning. Of course, since alternative tunings will apply variations in the uneven stresses applied to the guitar system, as a whole, different configurations may be utilized to effectively balance guitars utilizing such alternative tunings.

Once the strings are "in tune", then the method continues with the manipulation of the tremolo device one cycle, step 140. This cycling of the tremolo device stretches the tremolo tension springs to their maximum available length of travel and back to their neutral position.

Then, the two strings on opposite edges of the guitar tremolo device, which, on a standard tuned guitar are the high and low "E" strings, are re-tuned by adjusting spring tension, step 150. This is accomplished by either inserting or withdrawing the anchor screws 32 into the guitar body, thus effectively manipulating spring length, which either increases or decreases spring tension. Once the two "E" strings are returned to their proper pitch, the rest of the strings will fall right into their proper tuning. Steps 130 through 150 may be repeated a number of times, and preferably between 2 and 4 times to ensure the accuracy of the guitar and tremolo bridge tuning.

Accordingly, what is provided is a method of optimizing a spring-loaded tremolo device, which substantially balances the stresses applied to a guitar system at rest and, which substantially balances the stresses applied to the guitar system when the tremolo device is operated. The method relies upon the adjustment of tremolo spring tension during the guitar string tuning process to effectively balance the stresses applied to all of the guitar system components.

Of course, those skilled in the art will recognize that the principle of the present invention, namely counteracting asymmetrical guitar string tension by asymmetrically spring loading the tremolo device, is equally applicable to additional embodiments, which are considered to be within the scope of the present invention.

What is claimed is:

1. A method of optimizing a spring-loaded tremolo device including a base plate having a bridge fulcrum, a block and a plurality of tremolo device tension springs biasing said tremolo device in an at rest position, said method substantially balancing uneven stresses applied to a stringed instrument system, such as a guitar, caused by differing instrument string tensions applied by a plurality of string tension tuners, said method comprising the steps of:

asymmetrically loading said tremolo device to counteract said uneven stresses applied to the instrument by said differing string tensions;

ensuring that said bridge fulcrum is substantially free to rotate;

tuning said instrument to pitch by adjusting said instrument string tension using said string tension tuners;

cycling said tremolo device to stretch said tremolo tension springs to their maximum available length of travel and to return said tension springs back to a neutral position; and re-tuning said instrument by adjusting said tremolo spring tension until instrument strings at opposite edges of said tremolo device provide their proper pitches.

2. The method of optimizing a spring-loaded tremolo device as claimed in claim 1 further comprising the steps of pre-inspecting said guitar system to discover any potential failure points and resolving any of said discovered potential failure points.

3. The method of optimizing a spring-loaded tremolo device as claimed in claim 1, wherein said step of ensuring that said bridge fulcrum is substantially free to rotate comprises loosening tremolo device base plate hold-down screws slightly.

4. The method of optimizing a spring-loaded tremolo device as claimed in claim 1, wherein said step of asymmetrically loading the tremolo device comprises applying asymmetrical tremolo spring tension to the tremolo device to substantially counteract the tension applied to the tremolo device by the instrument strings.

5. The method of optimizing a spring-loaded tremolo device as claimed in claim 4, wherein said step of applying asymmetrical tremolo spring tension comprises utilizing an asymmetrical tremolo spring arrangement.

6. The method of optimizing a spring-loaded tremolo device as claimed in 1, wherein said step of asymmetrically loading the tremolo device comprises adjusting at least one tremolo spring anchor screw so that it extends a different amount into a tremolo spring recess provided in said instrument than a second tremolo spring anchor screw.

7. The method of optimizing a spring-loaded tremolo device as claimed in 1, wherein said step of asymmetrically loading the tremolo device comprises utilizing an asymmetrical tremolo spring tension plate.

8. A method of optimizing a spring-loaded tremolo device on a stringed instrument including a plurality of strings, said tremolo device including a plurality of tremolo tension springs, said method comprising the step of balancing uneven stresses applied to said string instrument by differing string tensions by adjusting tension applied by said tremolo tension springs in an asymmetrically manner so as to substantially counteract said uneven stresses applied to said stringed instrument by said differing string tensions.

* * * * *